US005200290A

United States Patent [19]

Ong et al.

[11] Patent Number: 5,200,290

[45] Date of Patent: Apr. 6, 1993

[54] LIQUID DEVELOPERS CONTAINING COLORED POLYMERS WITH A COLOR CHROMOPHORE COVALENTLY BOUND THERETO

[75] Inventors: Beng S. Ong, Mississauga; Melvin D. Croucher, Oakville; Raymond W. Wong, Mississauga, all of Canada

[73] Assignee: Xerox Corporation, Stamford, Conn.

[21] Appl. No.: 590,855

[22] Filed: Oct. 1, 1990

[51] Int. Cl.[5] ..... G03G 9/08; G03G 9/10

[52] U.S. Cl. ..... 430/115; 430/106; 528/183; 528/190; 528/290; 528/370

[58] Field of Search ..... 430/115, 106; 528/183, 528/190, 290, 291, 370

[56] References Cited

U.S. PATENT DOCUMENTS

| | | | |
|---|---|---|---|
| 4,375,357 | 3/1983 | Wingard, Jr. et al. | 8/647 |
| 4,645,727 | 2/1987 | Ong et al. | 430/106 |
| 4,764,446 | 8/1988 | Croucher et al. | 430/115 |
| 4,778,742 | 10/1988 | Ong et al. | 430/106 |

*Primary Examiner*—Marion E. McCamish
*Assistant Examiner*—S. Rasasco
*Attorney, Agent, or Firm*—Judith L. Byorick

[57] ABSTRACT

Disclosed is a liquid developer comprising a liquid medium, a charge control agent, a polymeric surfactant, and a colored core polymer. In one embodiment, the colored polymer is of the formula wherein A is selected from the group consisting of alkylene and arylene, B is selected from the group consisting of wherein R is selected from the group consisting of alkylene groups, arylene groups, and polyether groups, D is selected from the group consisting of dioxyalkane and dioxyarene, x is a fraction number of from about 0.01 to 1.0, and y is a fraction number of from 0 to about 0.99, with x+y being equal to 1, and n representing the number of the monomer units.

25 Claims, No Drawings

LIQUID DEVELOPERS CONTAINING COLORED POLYMERS WITH A COLOR CHROMOPHORE COVALENTLY BOUND THERETO

BACKGROUND OF THE INVENTION

The present invention is directed to liquid developer compositions. More specifically, the present invention is directed to liquid developers comprising a liquid medium, a charge control agent, a polymeric surfactant and a colored core polymer. The colored core polymer of the present invention is of the formula

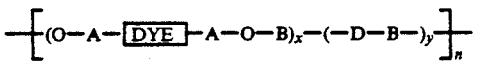

wherein A is selected from the group consisting of alkylene and arylene, B is selected from the group consisting of

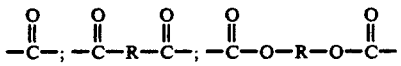

wherein R is an alkylene group, an arylene group, or a polyether segment, D is selected from the group consisting of dioxyalkane and dioxyarene, x is a fraction number of from about 0.01 to 1.0, and y is a fraction number of from 0 to about 0.99, with x+y being equal to 1, and n representing the number of the monomer units.

The formation and development of images on the surface of photoconductive materials by electrostatic means is well known. The basis electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Development of electrostatic latent images with liquid developer compositions is also known. Liquid electrophotographic developers generally comprise a liquid vehicle in which is dispersed charged colored toner particles. In liquid development processes, the photoreceptor bearing the electrostatic latent image is contacted with the liquid developer. Contact with the charged areas of the photoreceptor causes the charged toner particles present in the liquid vehicle to migrate through the liquid to the charged areas of the photoreceptor to develop the latent image. Thereafter, the photoreceptor is withdrawn from the liquid developer with the charged colored particles adhering to the electrostatic latent image in image configuration. The developed image is then typically transferred to a suitable substrate, such as paper or transparency material, and, optionally, may be fixed to the substrate by heat, pressure, a combination of heat and pressure, or other suitable fixing means such as solvent or overcoating treatment.

Colored particles in liquid electrophotographic developers frequently comprise pigmented resin particles, wherein either the pigment particles are dispersed in larger resin particles or pigment particles are coated with a resin. One difficulty that can arise with developers containing pigmented resin particles is inhomogeneous distribution and dispersion of the pigment particles within the resin, which can result in poor image color fidelity. In addition, liquid developers containing pigmented resin particles can form images wherein the pigment smears, which results primarily from weak binding of the pigment to the print substrate by the polymer. Further, pigments and pigmented particles tend to exhibit poor color mixing properties, which can impair image color quality. In addition, colored particles in liquid electrophotographic developers can comprise dyed polymeric particles, wherein the dye is imbibed into the polymeric particles. One difficulty that can arise with developers containing dyed polymeric particles is diffusion of the dye from the polymeric particle into the liquid vehicle of the developer, which results in undesirable background coloration of developed images.

Liquid developers of the present invention contain colored polymers as the colorant and the binding vehicle instead of conventional pigment/binder resin particles or dyed polymeric particles as typically employed in known liquid developers. The liquid developers of the present invention exhibit resistance to color smearing, since the colorant is also the binder material and no separation of colorant from binder polymer can occur. In addition, since the colorants of the liquid developers of the present invention are dyes covalently bound within a polymeric structure, the developers exhibit improved color mixing properties as a result of the dye-based colorant instead of a pigment-based colorant. Further, liquid developers of the present invention form images that exhibit excellent waterfastness because of the water insolubility of the colored polymeric particles of the developer. The liquid developers of the present invention also exhibit high color fidelity resulting from homogeneous dispersion of the colorant within the colored particles. In addition, the liquid developers of the present invention do not exhibit coloration of the liquid vehicle as a result of dye molecules diffusing from dyed polymeric particles, since the dye is an integral portion of the polymeric particles and is covalently bound thereto. Liquid developers of the present invention also have low toxicity compared to developers containing polymeric particles with dye molecules imbibed therein, since dye molecules, which are frequently toxic, do not diffuse from the particles into the liquid vehicle of the present invention.

Colored polymeric materials are known. For example, U.S. Pat. No. 4,375,357 (Wingard, Jr. et al.) discloses a family of water-soluble noncrystalline polymeric black colorants composed of an organic polymer backbone with a plurality of aromatic rings from which depend via azo. groups a plurality of chromophore units. The water-soluble polymeric colorants form dyes and inks that are fast to paper stock.

In addition, U.S. Pat. No. 4,645,727 (Ong et al.) the disclosure of which is totally incorporated herein by reference, discloses a dry toner comprising resin particles and covalently bonded polymeric dye chromophores of the formula $$(O-A-\boxed{DYE}-A-O-B)_x(-D-B-)_y$$

wherein A is selected from the group consisting of alkylene and arylene, B is selected from the group consisting of $$-\overset{O}{\overset{\|}{C}}-;\ -\overset{O}{\overset{\|}{C}}-R-\overset{O}{\overset{\|}{C}}-;\ -\overset{O}{\overset{\|}{C}}-O-R-O-\overset{O}{\overset{\|}{C}}-$$

wherein R is an alkylene group, an arylene group, or a polyether segment, D is selected from the group consisting of dioxyalkane and dioxyarene, x is a fraction number of 0.01 to 0.50, and y is a fraction number of 0.50 to 0.99, with x+y being equal to 1.

Further, U.S. Pat. No. 4,778,742 (Ong et al.), the disclosure of which is totally incorporated herein by reference, discloses a dry toner comprising resin particles and polymeric dye components of the formula $$(O-A-\boxed{DYE}-A-O-B)_x$$

wherein A is selected from the group consisting of alkylene and arylene, B is selected from the group consisting of $$-\overset{O}{\overset{\|}{C}}-;\ -\overset{O}{\overset{\|}{C}}-R-\overset{O}{\overset{\|}{C}}-;\ -\overset{O}{\overset{\|}{C}}-O-R-O-\overset{O}{\overset{\|}{C}}-$$

wherein R is selected from the group consisting of an alkylene group, an arylene group, and a polyether group, and x represents a number of from 2 to about 100.

Although the known compositions are suitable for their intended purposes, a need remains for liquid developers that exhibit resistance to color smearing. In addition, there is a need for liquid developers that exhibit improved color mixing properties. Further, there is a need for liquid developers that form images which exhibit excellent waterfastness. A need also exists for liquid developers that exhibit high color fidelity. There is also a need for liquid developers containing colored particles exhibiting homogeneous dispersion of the colorant within the particles. Further, a need exists for liquid developers with improved lightfastness characteristics. In addition, there is a need for liquid developers having the advantages of a developer containing dyed particle but which does not exhibit diffusion of the dye into the liquid vehicle, thereby improving image quality and reducing background coloration of developed images. There is also a need for liquid developers having the advantages of a developer containing dyed particle but which does not exhibit diffusion of the dye into the liquid vehicle, thereby greatly improving the toxicological properties of the developer. Additionally, there is a need for developers with the above noted advantages that can be employed in liquid development processes, thereby enabling development of images of superior quality and resolution.

SUMMARY OF THE INVENTION

It is an object of the present invention to provide liquid developers that exhibit resistance to color smearing.

It is another object of the present invention to provide liquid developers that exhibit improved color mixing properties.

It is yet another object of the present invention to provide liquid developers that form images which exhibit excellent waterfastness.

It is still another object of the present invention to provide liquid developers that exhibit high color fidelity.

Another object of the present invention is to provide liquid developers containing colored particles exhibiting homogeneous dispersion of the colorant within the particles.

Yet another object of the present invention is to provide liquid developers with improved lightfastness characteristics.

Still another object of the present invention is to provide liquid developers having the advantages of a developer containing dyed particle but which does not exhibit diffusion of the dye into the liquid vehicle, thereby improving image quality and reducing background coloration of developed images.

It is another object of the present invention to provide liquid developers having the advantages of a developer containing dyed particle but which do not exhibit diffusion of the dye into the liquid vehicle, thereby greatly improving the toxicological properties of the developer.

It is yet another object of the present invention to provide developers with the above noted advantages that can be employed in liquid development processes, thereby enabling development of images of superior quality and resolution.

These and other objects of the present invention can be achieved by providing a liquid developer comprising a liquid medium, a charge control agent, a polymeric surfactant and a colored core polymer. In one embodiment, the colored core polymer is of the formula $$-\left[(O-A-\boxed{DYE}-A-O-B)_x-(-D-B-)_y\right]_n-$$

wherein A is selected from the group consisting of alkylene and arylene, B is selected from the group consisting of $$-\overset{O}{\overset{\|}{C}}-;\ -\overset{O}{\overset{\|}{C}}-R-\overset{O}{\overset{\|}{C}}-;\ -\overset{O}{\overset{\|}{C}}-O-R-O-\overset{O}{\overset{\|}{C}}-$$

wherein R is an alkylene group, an arylene group, or a polyether segment, D is selected from the group consisting of dioxyalkane and dioxyarene, x is a fraction number of from about 0.01 to 1.0, and y is a fraction number of from 0 to about 0.99, with x+y being equal to 1, and n representing the number of the monomer units. Yet another embodiment of the present invention is directed to an imaging process which comprises forming an electrostatic latent image on an imaging member, developing the image with a developer composition of the present invention, transferring the developed image to a suitable substrate, and optionally thereafter permanently affixing the transferred image to the substrate.

DETAILED DESCRIPTION OF THE INVENTION

The liquid developers of the present invention comprise a liquid medium, a charge control agent, a polymeric surfactant and colored polymeric core particles. Typical liquid media are colorless, odorless, nontoxic and nonflammable, generally have flash points greater than 104° F., and include aliphatic hydrocarbons. The liquid medium typically may be any of several hydrocarbon liquids conventionally employed for liquid development processes, such as hydrocarbons, including high purity alkanes having from about 7 to about 18 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. Particularly preferred are Isopar® G and Isopar® L. Generally, the liquid medium is present in a large amount in the developer composition, and constitutes that percentage by weight of the developer not accounted for by the other components. The liquid medium is present in an effective amount, generally from about 70 to about 99.9 percent by weight, although the amount can vary from this range.

The liquid developer preferably includes a charge control agent to give the colored particles charge in order for them to undergo electrophoresis in an electric field. Any suitable charge control agent selected from the well known agents for such purpose may be used. Useful charge control agents include the lithium, cadmium, calcium, manganese, magnesium and zinc salts of heptanoic acid; the barium, aluminum, cobalt, manganese, zinc, cerium and zirconium salts of 2-ethyl hexanoic acid, (these are known as metal octoates); the barium, aluminum, zinc, copper, lead and iron salts of stearic acid; the calcium, copper, manganese, nickel, zinc and iron salts of naphthenic acid; and ammonium lauryl sulfate, sodium dihexyl sulfosuccinate, sodium dioctyl sulfosuccinate, aluminum diisopropyl salicylate, aluminum dresinate, aluminum salt of 3,5 di-t-butyl gamma resorcylic acid. Mixtures of these materials can also be used. Particularly preferred charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc with heptanoic acid; salts of barium, aluminum, cobalt, manganeses, zinc, cerium, and zirconium octoates; salts of barium, aluminum, zinc, copper, lead, and iron with stearic acid; iron naphthenate; and the like, as well as mixtures thereof. The charge control agent is present in an effective amount, generally from about 0.001 to about 2 percent by weight, and preferably from about 0.01 to about 0.8 percent by weight of the developer composition, although the amount can be outside of this range.

The polymeric surfactant helps break down the colored core polymer into small particles during preparation of the liquid developer and then functions to stabilize and charge the core particles once they are formed. The ideal surfactant is polymeric in nature and is one that will be completely soluble in the liquid medium at high temperature but will be only slightly soluble, but not completely insoluble, at ambient temperatures. The resin is typically soluble in the liquid vehicle at elevated temperatures of from about 75° C. to about 125° C., and is typically insoluble in the liquid vehicle at ambient temperatures of from about 10° C. to about 65° C. Suitable polymeric surfactants include polyolefins and halogenated polyolefins, such as polyhexadecene, polyoctadecene, poly(ethylene-covinyl acetate), and chlorinated polyolefins. Preferred resins include chlorinated polypropylene, such as CP-343-1, available from Eastman Kodak Company, polyhexadecene, and polyoctadecene. The preferred polyhexadecenes are of the general formula $(C_{16}H_{36})_x$, and the preferred polyoctadecenes are of the general formula $(C_{18}H_{36})_x$, wherein x is a number of from about 250 to about 21,000, the number average molecular weight is from about 17,500 to about 1,500,000 as determined by GPC, and the $M_w/M_n$ dispersibility ratio is from about 2 to about 15. The polyhexadecenes and polyoctadecenes can be prepared by, for example, the methods set forth in U. Giannini, G. Bruckner, E. Pellino, and A. Cassatta, *Journal of Polymer Science*, Part C (22), pages 157 to 175 (1968), and in K. J. Clark, A. Turner Jones, and D. G. H. Sandiford, *Chemistry in Industry*, pages 2010 to 2012 (1962), the disclosures of each of these articles being totally incorporated herein by reference. Particularly preferred for this application is chlorinated polypropylene which is obtained as CP-343 from the Eastman Kodak Company. Generally, the polymeric surfactant is present in an effective amount, typically from about 0.1 to about 10 percent by weight, and preferably from about 0.3 to about 5 percent by weight of the developer composition, although the amount can be outside of the range. Further information concerning liquid developers containing polymeric surfactants of this type is disclosed in copending application U.S. Ser. No. 07/300,395 (D/88097), entitled "Liquid Developer Compositions Containing Polyolefin Resins", with the named inventors S. Drappel, T. J. Fuller, M. D. Croucher, J. D. Mayo, and R. W. Wong, filed Jan. 23, 1989, the disclosure of which is totally incorporated herein by reference.

The colored polymeric particles in the liquid developers of the present invention generally comprise a polymeric backbone having a color chromophore covalently bound thereto. The polymer can be either a homopolymer or a copolymer of two or more different monomers, wherein the dye is covalently bound to an effective percentage of the monomers to result in the desired degree and intensity of coloration of the liquid developer containing the particles. Generally, from about 0.01 mole percent to about 1.0 mole percent of the monomers have a chromophore covalently bound thereto, and preferably from about 0.05 mole percent to about 1.0 mole percent. In addition, more than one species of dye chromophore can be covalently bound to the same polymer; for example, both red and yellow dye chromophores can be covalently bound to the polymer to result in an orange colored polymer. The colored polymer is present in the liquid developers of the present invention in an effective amount, generally from about 0.1 to about 30 percent by weight, and preferably from about 0.5 to about 10 percent by weight.

the colored polymers of the developers of the present invention can be of the formula

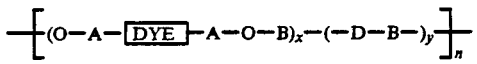

wherein A is selected from the group consisting of alkylene and arylene, B is selected from the group consisting of

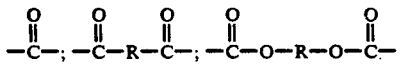

wherein R is an alkylene group, an arylene group, or a polyether segment, D is selected from the group consisting of dioxyalkane and dioxyarene, x is a fraction number of from about 0.01 to 1.0, and y is a fraction number of from 0 to about 0.99, with x+y being equal to 1, and n representing the number of the monomer units.

The value of n can be any number that results in a polymer with suitable physical characteristics for use in a liquid developer. Generally, n ranges from about 2 to about 200, although the value of n can be outside of this range.

Examples of alkylene substituents include those of from about 1 to about 20 carbon atoms, and preferably from 1 to about 6 carbon atoms, including methylene, ethylene, propylene, butylene, tetramethylene, pentamethylene, hexamethylene, and the like. Examples of arylene substituents include those of from about 6 carbon atoms to about 24 carbon atoms, such as phenylene and the various derivatives thereof, xylenylene, phenylenediethylene, phenylene-1,3-propylene, 4,4'-biphenylenedimethylene, and the like. Examples of polyether segments include diethylene ether, dipropylene ether, triethylene ether, tetraethylene ether, and the like.

Specific illustrative examples of A substituents include

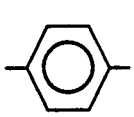

i) para-phenylene

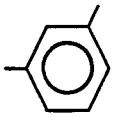

ii) meta-phenylene

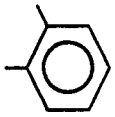

iii) ortho-phenylene

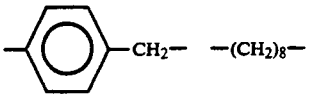

iv) para-benzylene v) 1,8-octamethlene

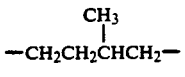

vi) 3-methyl-1,4-butylene

With regard to compositions represented by the above formula, illustrative examples of D substituents include:

i)

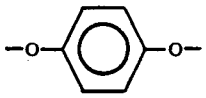

ii)

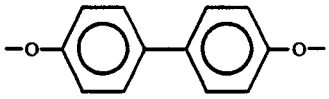

iii)

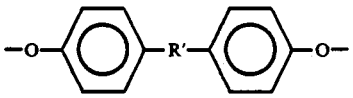

wherein R' is an oxygen atom, sulfur atom, sulfoxide group, sulfone group, dialkylsilyl group, alkylene group, arylene group, or alkarylene group. Alkylene, arylene and alkarylene groups include methylene, ethylene, propylene, dimethylmethylene, phenylene, tolylene, benzylene, p-phenylenedimethylene, diphenylmethylene, and the like.

Examples of the dye chromophores, DYE, are illustrated by the following general formulae:

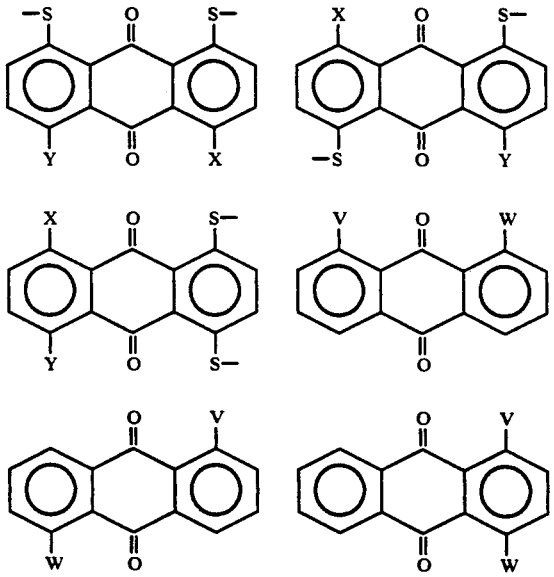

wherein X and Y are independently selected from the group consisting of $SC_6H_5$, $SCH_3$, $SC_2H_5$, and H; V and W are independently selected from the group consisting of $NH(CH_2)_n$—, $NHC_6H_4$—, $NH(CH_2)_nC_6H_4$—, and $NHC_6H_4(CH_2)_n$—; and n is a number of from zero to about 20.

Specific illustrative examples of colored polymer compositions encompassed by the above formulas wherein the substituents are as defined herein include:

(X)
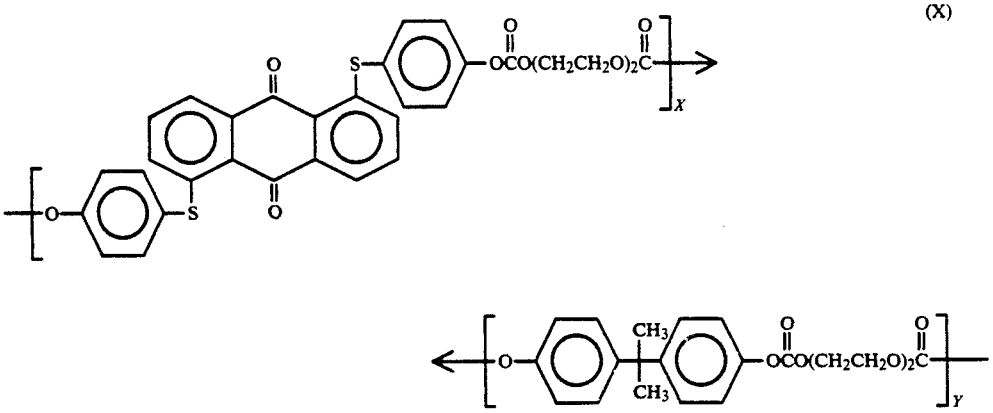
(XI)
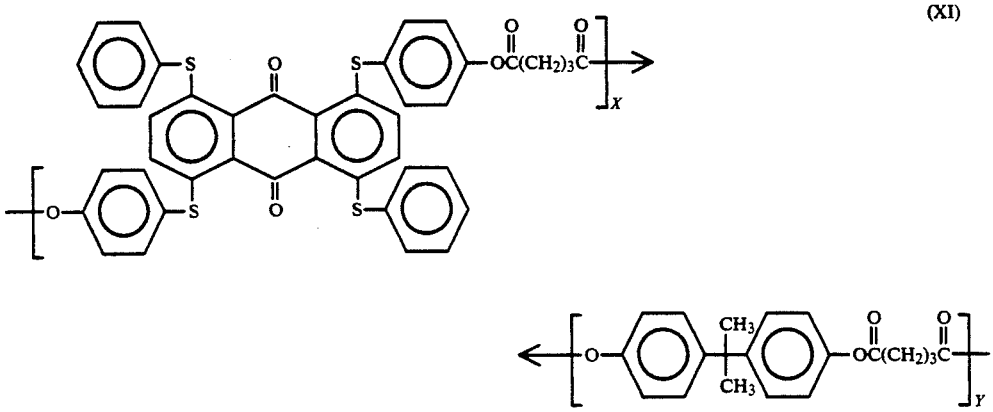
(XII)
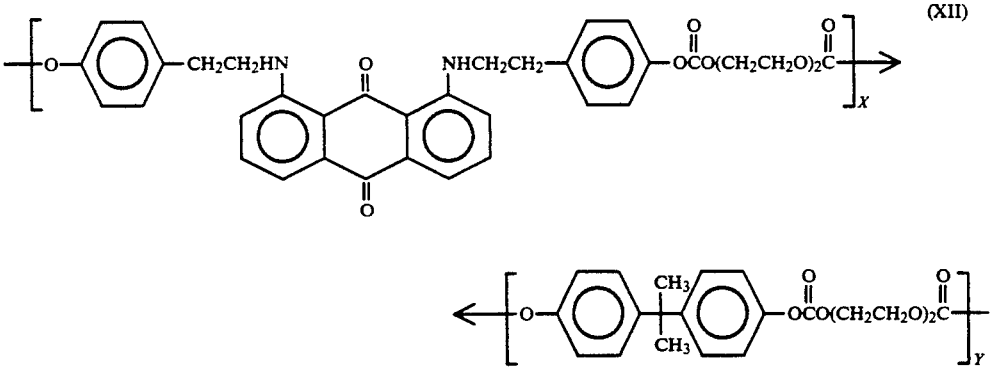
(XIII)
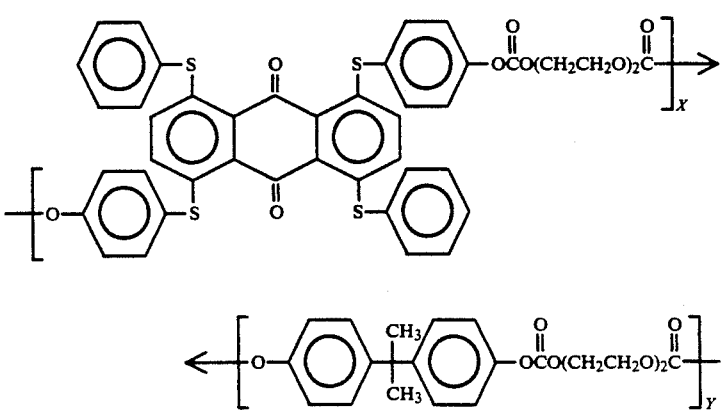

-continued
(XIV)
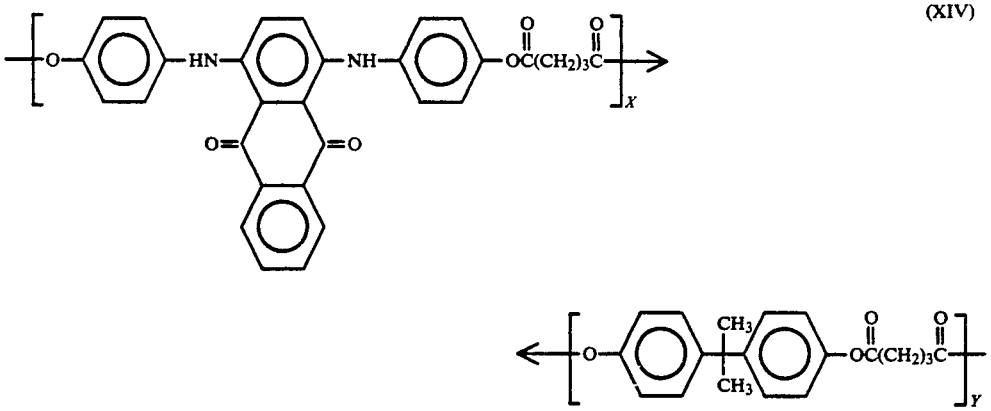
(XV)
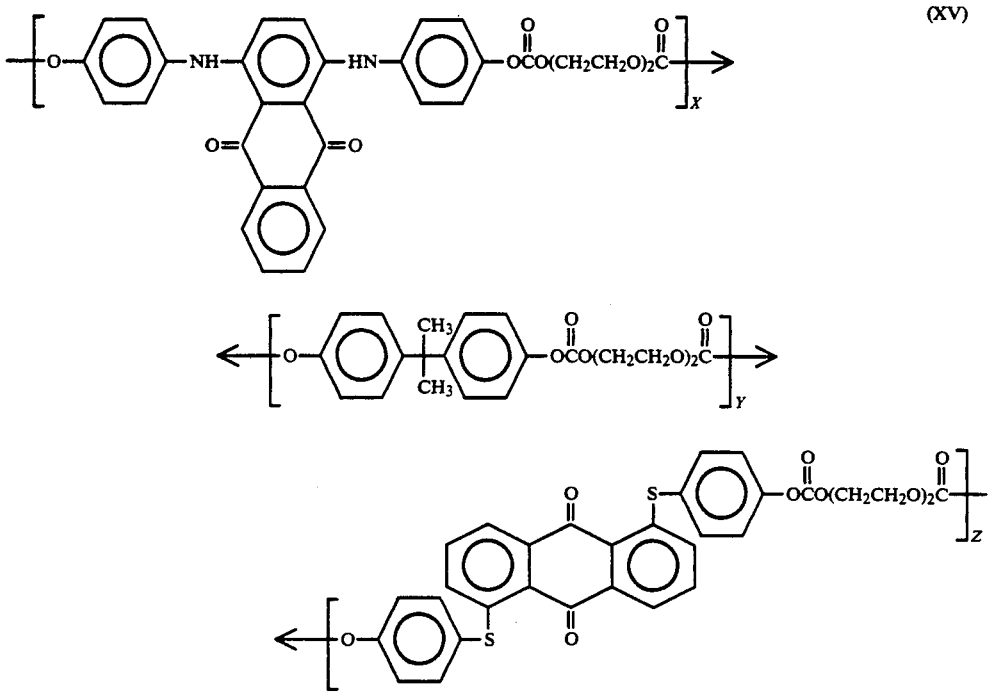
with Y being a number of from 0 to 0.99, and X+Z being a number that equals 0.01 to 1.0.
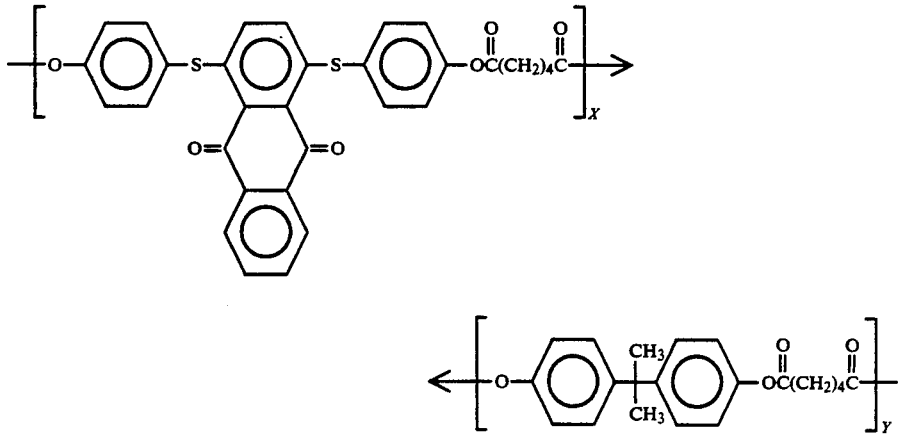
(XVI)

-continued

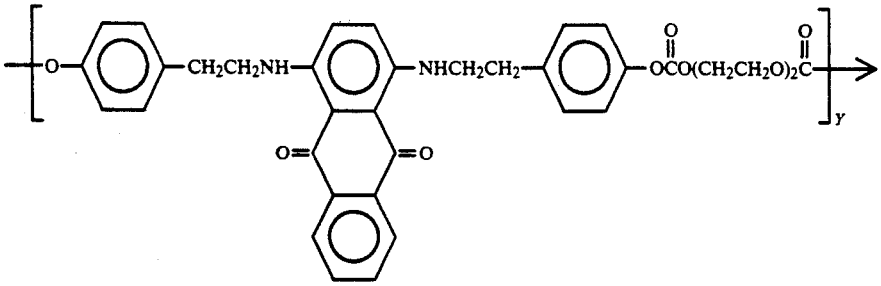

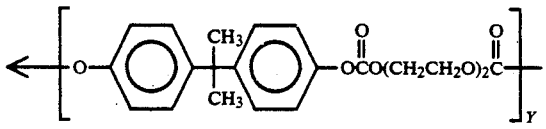

(XVII)

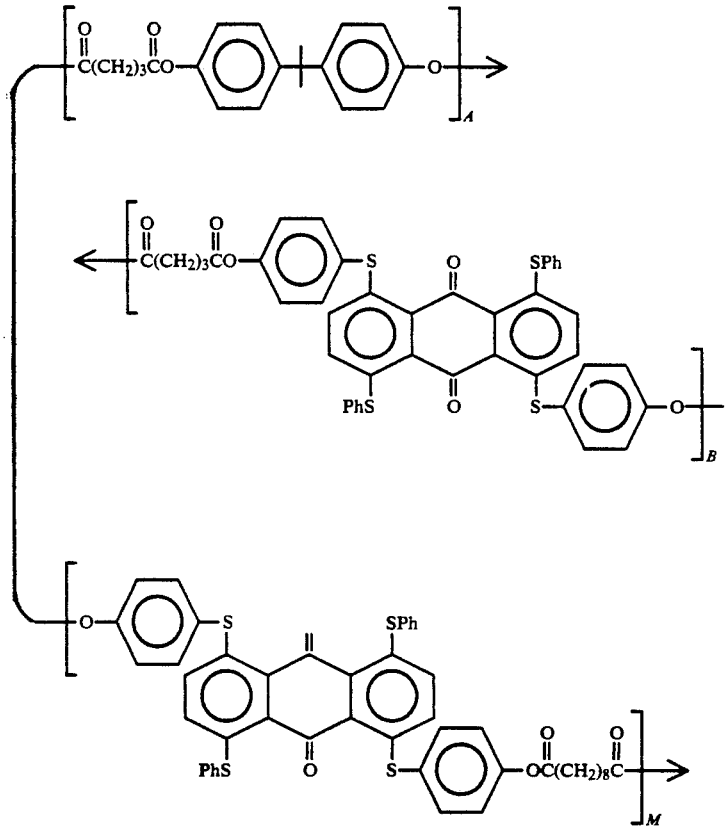

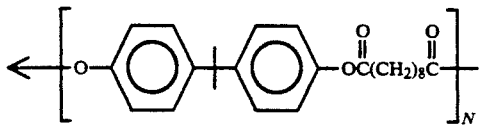

(XVIII)

wherein B+M ranges from about 0.01 to 1.0; and A+N ranges from 0 to about 0.99.

The colored polymers can be synthesized by a number of suitable processes. In one process embodiment, yellow, red, and blue anthraquinone dyes are functionalized to the respective bisphenolic dyes, followed by the polycondensation of these dyes and certain bisphenols with diacyl halides or bishaloformates. More specifically, the reaction scheme for the preparation of a colored polycarbonate or polyester is illustrated with reference to the following reaction scheme:

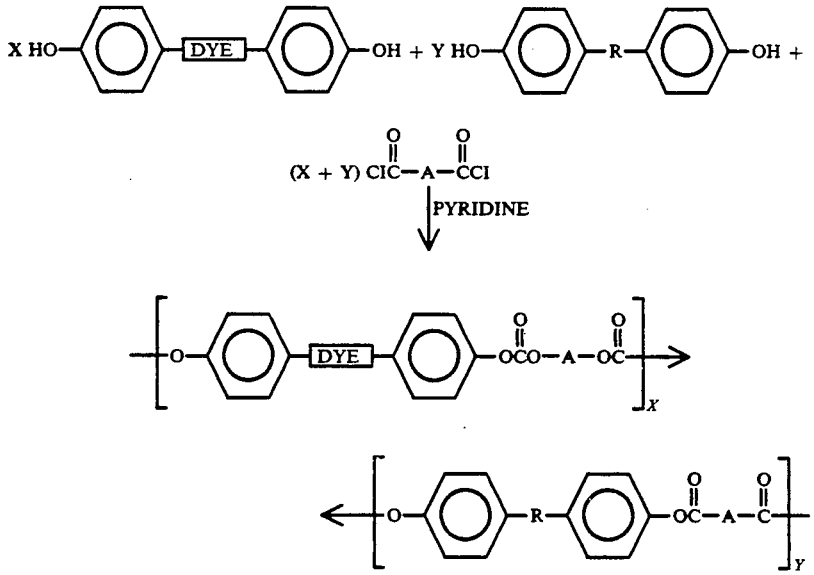

wherein A is R′ or —OR′O—, with R′ being alkylene, arylene, or their derivatives.

Examples of specific functionalized bisphenolic dyes suitable for the reaction include:

(I)

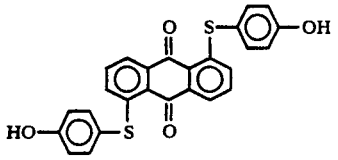

1,5-Bis(p-hydroxyphenylthio)anthraquinone(YELLOW)

(II)

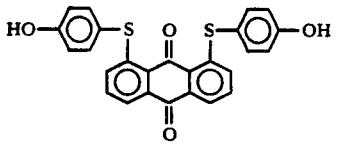

1,8-Bis(p-hydroxyphenylthio)anthraquinone(YELLOW)

(III)

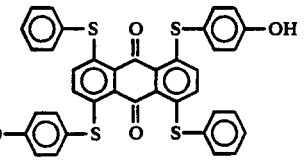

1,5-Bis(p-hydroxyphenylthio)-4,8-bis(phenylthio)anthraquinone (RED)

(IV)

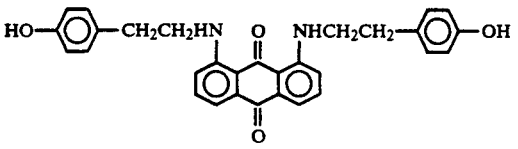

1,8-Bis[2-(phydroxyphenyl)ethylamino]anthraquinone(RED)

-continued (V)

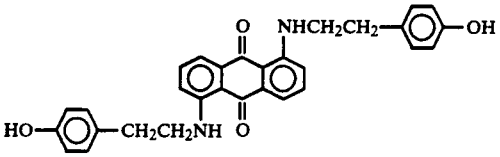

1,5-Bis[2-(p-hydroxyphenyl)ethylamino]anthraquinone(RED)

(VI)

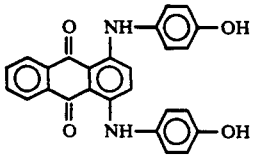

1,4-Bis(p-hydroxyphenylamino)anthraquinone(BLUE)

(VII)

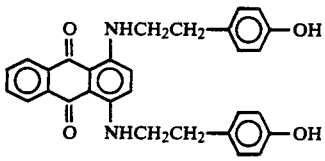

1,4-Bis[2-(p-hydroxyphenyl)ethylamino]anthraquinone(BLUE)

(VIII)

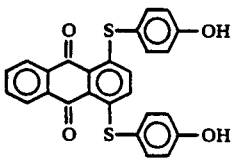

1,4-(p-hydroxyphenylthio)anthraquinone(RED)

(IX)

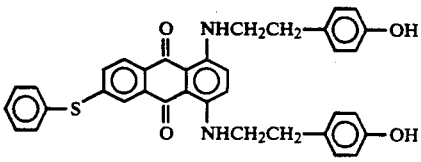

6-phenylthio-1,4-bis[2-(p-hydroxyphenyl)ethylamino] anthraquinone(GREEN)

Examples of bisphenols suitable as comonomers in the polycondensation are 1,4-dihydroxybenzene,4,4'-dihydroxybiphenyl,bis(p-hydroxyphenyl) ether; bis(p-hydroxyphenyl) sulfide; bis(p-hydroxyphenyl) sulfoxide; bis(p-hydroxyphenyl) sulfone; dimethyl-bis(p-hydroxyphenyl)silane; bis(o-hydroxyphenyl)methane; bis(m-hydroxyphenyl)methane; bis(p-hydroxyphenyl)methane; 1,2-bis(p-hydroxyphenyl)ethylene; 2,2-bis(p-hydroxyphenyl)propane; 1,2-bis(hydroxyphenyl)ethane; 1,1-bis(p-hydroxyphenyl)butane; 2,2-bis(p-hydroxyphenyl)butane; 2,2-bis(p-hydroxyphenyl)hexane; 1,1-bis(p-hydroxyphenyl)cyclopentane; and similar equivalents thereof.

Examples of diacyl halides suitable for the polyesterification reaction include succinyl chloride, glutaryl chloride, adipoyl chloride, dimethylglutaryl chloride, suberyl chloride, phthaloyl chloride, isophthaloyl chloride, terephthaloyl chloride, and the like. Examples of bishaloformates suitable for the reactions include ethyleneglycol bischloroformate, diethyleneglycol bischloroformate, triethyleneglycol bischloroformate, tetraethyleneglycol chloroformate, biphenoxy chloroformate, propyleneglycol chloroformate, dipropyleneglycol chloroformate, butyleneglycol chloroformate, ethyleneglycol bromoformate, propyleneglycol bromoformate, and the like.

More specifically, with regard to the process of preparation the funtionalized dye and a bisphenol are dissolved in a suitable organic solvent such as methylene chloride in the presence of an organic base such as pyridine at room temperature, with the molar ratio of the dye to bisphenol being from 0.01 to 0.50, and preferably from 0.04 to 0.30. However, the actual molar ratio employed depends largely on the molar absorptivity of the functionalized dye to enable the resultant colored polymer to possess the required optical density for imaging purposes. Therefore, for each mole of the bisphenoxy compound, 2 to 5 moles of pyridine are used. Further, the concentration of the bisphenoxy compounds is approximately 5 to 15% (w/v). Subsequently, the solution is mechanically stirred and cooled by means of an ice bath to slightly below 10° C., and 0.1 mole of freshly distilled diacyl halide (for polyester resins) or bishaloformate (for polycarbonate resins) is then added dropwise over a period of 5 to 30 minutes. The reaction temperature is maintained at below 15° C. during addition. After addition, the ice bath is removed, and the reaction mixture is further stirred at room temperature for another 1 to 5 hours to complete the polymerization. The reaction mixture is then diluted with 2 folds of solvent, and the resulting solution is washed several times with water to remove pyridinium halide and excess pyridine. Subsequently, the organic phase is separated, dried with magnesium sulfate, filtered and concentrated to about half of its original volume. The colored polymer product is precipitated by pouring the above organic solution into a swirling methanol or hexane. The precipitated polymer is filtered, washed thoroughly with methanol or hexane, and dried in vacuo.

A specific class of suitable colored polymers for the liquid developers of the present invention are of the formula $$(-O-A-\boxed{DYE}-A-O-B-)_n$$

wherein A is selected from the group consisting of alkylene and arylene, B is selected from the group consisting of $$-\overset{O}{\overset{\|}{C}}-;\ -\overset{O}{\overset{\|}{C}}-R-\overset{O}{\overset{\|}{C}}-;\ -\overset{O}{\overset{\|}{C}}-O-R-O-\overset{O}{\overset{\|}{C}}-$$

wherein R is selected from the group consisting of an alkylene group, an arylene group, and a polyether group, and n represents the number of repeating units, generally ranging from about 2 to about 100. These polymers are a subclass of those of the general formula $$-\left[(O-A-\boxed{DYE}-A-O-B)_x-(-D-B-)_y\right]_n-$$

and represent the situation wherein y is 0.

Examples of alkylene groups include those of from 1 to about 6 carbon atoms, including methylene, ethylene, propylene, butylene, tetramethylene, pentamethylene, hexamethylene, and the like. Examples of arylene substituents include those containing from about 6 carbon atoms to about 24 carbon atoms, such as phenylene and the various derivatives thereof, tolylene, benzylene, biphenylene, and the like. Alkarylene groups may also be selected such as xylene, phenylene diethylene, phenylene-1,3-propylene, 4,4'-biphenylene dimethylene, and the like. Examples of polyether segments include diethylene ether, dipropylene ether, triethylene ether, tetraethylene ether, and the like.

Specific illustrative examples of the A substitutents include

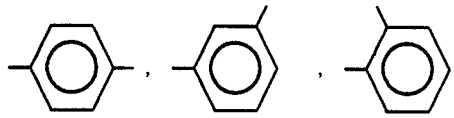

i) para-phenylene ii) meta-phenylene iii) ortho-phenylene

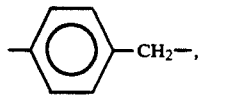

$-CH_2-$, $-(CH_2)_8-$, and iv) para-benzylene v) 1,8-octamethylene $$-CH_2CH_2\overset{CH_3}{\overset{|}{C}}HCH_2-,$$

vi) 3-methyl-1,4-butylene

Dye chromophores suitable for colored polymers of this formula include those disclosed hereinabove as suitable chromophores for the copolymers of the formula $$-\left[(O-A-\boxed{DYE}-A-O-B)_x-(-D-B-)_y\right]_n-$$

Specific illustrative examples of colored polymers of the formula include:
$$(-O-A-\boxed{DYE}-A-O-B-)_n$$
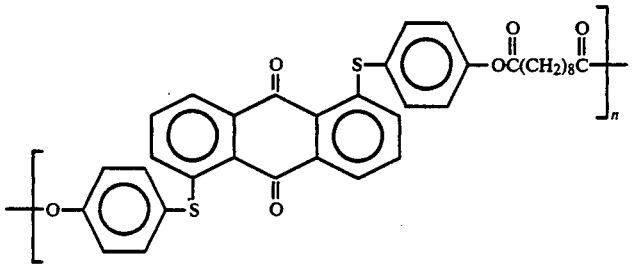
YELLOW POLYESTER
(XX)
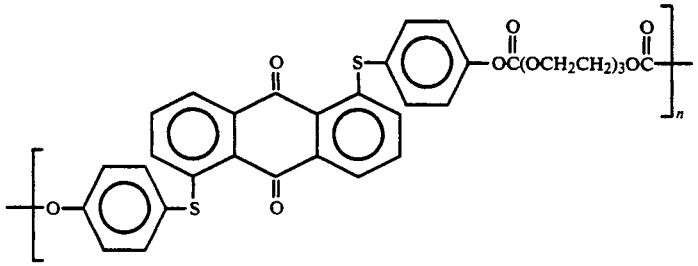
YELLOW POLYCARBONATE
(XXI)
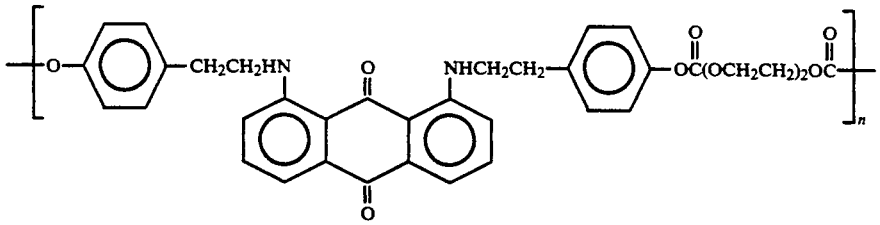
RED POLYCARBONATE
(XXII)
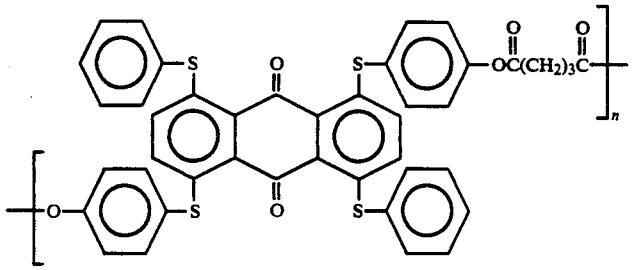
RED POLYESTER
(XXIII)

-continued

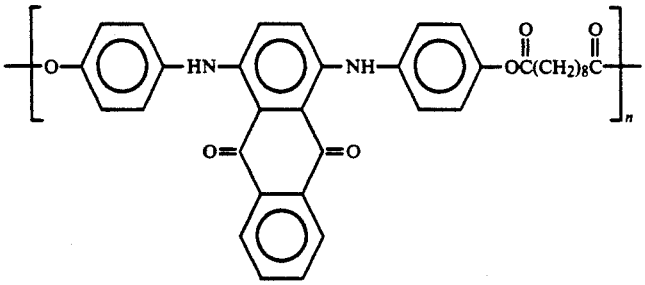

BLUE POLYESTER
(XXIV)

and

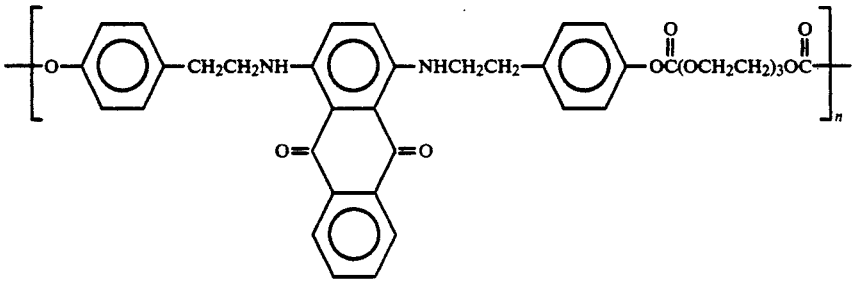

BLUE POLYCARBONATE
(XXV)

These colored polymers can be prepared by solution polymerization processes, interfacial polymerization processes, or the like. In solution polymerization processes, stoichiometric amounts of appropriate monomers are reacted in a suitable solvent medium such as an aliphatic halogenated hydrocarbon (methylene chloride for example) in the presence of an excess amount of a tertiary amine such as triethylamine base. Polymerization is then effected at a temperature of from about 5° C. to about 30° C. and completed in from about 0.5 to 3 hours. With interfacial polymerization processes, a bisphenoxy-functionalized dye is initially dissolved in an aqueous alkaline solution in the presence of an emulsifying agent. Thereafter, the resulting solution is stirred and treated with a solution of an appropriate bifunctionalized reagent, such as a diacyl chloride or bischloroformate, in a water immiscible solvent such as methylene chloride to obtain, respectively, the colored polyester or the colored polycarbonate. The colored polymers from the solution polymerization process are then further treated by washing the reaction mixture with water, followed by precipitation of a methylene chloride solution of the dyes from a nonsolvent such as hexane or methanol. With interfacial polymerization processes, the polymeric colorants are separated by simple filtration, followed by washing thoroughly with water.

SOLUTION POLYCONDENSATION PROCESS

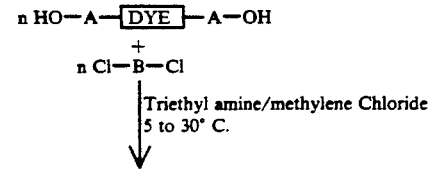

-continued

SOLUTION POLYCONDENSATION PROCESS

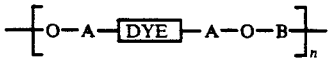

where as illustrated herein B is selected from the group consisting of

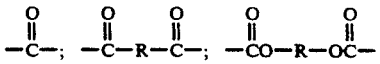

R is selected from the group consisting of an alkylene group, an arylene group, and a polyether group; and n represents the number of repeating units; and the other substituents are as described hereinbefore.

INTERFACIAL POLYCONDENSATION PROCESS

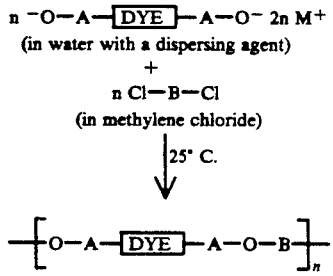

where $M^+$ is potassium or sodium cation; and A, B, and n are as described herein.

Examples of specific bisphenoxy-functionalized dyes selected as reactants include those disclosed herein above as suitable bisphenoxy-functionalized dyes suitable for preparation of colored polymers of the formula $$-\left[(O-A-\boxed{DYE}-A-O-B)_x-(-D-B-)_y\right]_n-$$

Examples of diacyl halide reactants include succinyl chloride, glutaryl chloride, adipoyl chloride, dimethylglutaryl chloride, sebacoyl chloride, phthaloyl chloride, isophthaloyl chloride, terephthaloyl chloride, and the like. Illustrative examples of bishaloformates selected include ethyleneglycol bischloroformate, diethyleneglycol bischloroformate, triethyleneglycol bischloroformate, tetraethyleneglycol bischloroformate, biphenoxy bischloroformate, propylene-glycol bischloroformate, dipropyleneglycol bischloroformate, butyleneglycol bischloroformate, ethyleneglycol bisbromoformate, propyleneglycol bisbromoformate, and the like.

More specifically, with regard to the preparation by a solution polycondensation process, the functionalized dye is dissolved in a suitable organic solvent such as methylene chloride in the presence of an organic base such as pyridine at room temperature with the molar ratio of the base to dye being from 2 to 10, and preferably from 2 to 4. Therefore, for each mole of the functionalized dye, about 2 to about 4 moles of pyridine are used. The concentration of the functionalized dye is approximately 5 to 25 percent (w/v). Thereafter, the resulting solution is mechanically stirred and cooled by means of an ice bath to slightly below 10° C., and 1.0 mole of freshly distilled diacyl halide (for polyester dyes) or bishaloformate (for polycarbonate dyes) is then added dropwise over a period of 5 to 30 minutes, while the reaction temperature is maintained at below 15° C. during addition. After addition, the ice bath is removed and the reaction mixture is further stirred at room temperature for another 1 to 5 hours to complete the polymerization. The reaction mixture is then diluted with solvent, and the resulting solution is washed several times with water to remove, for example, pyridinium halide and excess pyridine. Subsequently, the organic phase is separated, dried with magnesium sulfate, filtered, and concentrated to about half of its original volume. The resulting colored polymer can then be precipitated by pouring the above organic solution into a swirling methanol or hexane. Thereafter, the precipitated polymer product is filtered, washed thoroughly with methanol or hexane, and dried in vacuo.

For the interfacial process, the functionalized dye is first dissolved in an aqueous alkaline base solution such as potassium or sodium hydroxide solution. Subsequently, the solution resulting is stirred vigorously at room temperature in the presence of a dispersing agent such as sodium lauryl sulfate typically in an amount ranging from 0.5 to 10 percent by weight of the dye. To the solution is then added dropwise a solution of a bifunctional coupling agent such as diacyl chloride for the polyester dye synthesis, or bishaloformate for the polycarbonate dye synthesis, in methylene chloride or ethyl acetate. After the reaction, generally completed in about 10 to 60 minutes, the precipitated colored polymer is filtered, washed with water, and dried in vacuo for 12 hours.

Functionalized bisphenolic dyes employed to prepare homopolymers and copolymers as disclosed hereinabove can be prepared by a number of different methods. In one process embodiment, a chlorinated anthraquinone precursor, such as 1,5-dichloroanthraquinone; 1,8-dichloroanthraquinone; or 1,4-dichloroanthraquinone, is first dissolved in a suitable organic solvent such as dimethylformamide in the presence of a base such as potassium carbonate, followed by the addition of a hydroxyarenethiol. The molar ratio of the thiol to the chlorinated anthraquinone is from about 2.0 to about 2.25. Subsequently, the solution is mechanically stirred and heated to reflux for from 1 to about 24 hours. Thereafter, the reaction mixture is cooled, poured into water, and filtered. The solid product resulting is then washed with water and dried. Subsequently, the functionalized dye obtained is purified by recrystallization from an appropriate solvent such as acetic acid.

A second process entails reacting a chlorinated anthraquinone with an alkylaminophenol in a suitable organic solvent, such as o-dichlorobenzene, with the molar ratio of the aminophenol to chlorinated anthraquinone being 2.0 to 2.25. The mixture resulting is mechanically stirred and heated to 160° C. for from 8 to 24 hours. Subsequently, the reaction mixture is cooled to room temperature, and the product collected by filtration. The functionalized dye obtained is purified by recrystallization from an appropriate solvent such as isopropanol.

A third process entails the treatment of a solution of a chlorinated nitroanthraquinone, such as 1,5-dichloro-4,8-dinitroanthraquinone, in a suitable organic solvent such as dimethylformamide with an aryl thiol in the presence of a base such as potassium carbonate at room temperature, with the molar ratio of thio to anthraquinone being 2.0. After about 3 hours at room temperature, a hydroxyarenethiol is added, and the reaction mixture is subsequently heated to reflux for from 1 to 4 hours. The molar ratio of the thiol to anthraquinone is 2.0 to 2.25. Subsequently, the reaction mixture is cooled to room temperature, and poured into water. The product resulting is filtered, washed with water and methanol, and dried to yield the desired bisphenolic dye.

Another process entails reaction of a hydroxy anthraquinone such as quinizarine and leucoquinizarine with an alkylaminophenol in a suitable solvent such as pyridine. The molar ratio of the aminophenol to hydroxy anthraquinone is 2.0 to about 2.25. Subsequently, the reaction mixture is mechanically stirred and heated to reflux for from 1 to about 24 hours. The mixture is then cooled and poured into water, and the resulting solid product is filtered, washed with water, and dried, followed by recrystallization from an appropriate solvent such as acetic acid to yield the pure bisphenolic dye.

Liquid developers of the present invention generally can be prepared by mixing the polymeric surfactant and the liquid medium, for example in an attritor such as a Union Process 01 Attritor, available from Union Process Inc., Akron, Ohio, with heating at a temperature sufficient to cause the polymeric surfactant to become soluble in the liquid medium. To this heated solution is added the colored resin, which melts in the liquid to form a resin/surfactant/liquid medium mixture wherein the liquid medium functions as a diluent for the resin/surfactant mixture and lowers its viscosity. The liquid medium and the resin/surfactant mixture typically are mixed for a period of from about 30 minutes to about 2 hours. Generally, the liquid medium is present in the mixture in an amount of from about 80 percent by weight to about 90 percent by weight, and preferably is present in a amount of from about 82 to about 94 percent by weight. Subsequently, the mixture obtained is cooled to ambient temperature over a period, for example, of from about 1 to about 6 hours, resulting in formation of a dispersion of colored toner particles consisting of "core" particles of the colored copolymer and polymeric surfactant molecules associated with the "core" copolymer particles, said toner particles having an average particle diameter of from about 1 to about 6 microns. The concentrated dispersion is then diluted with an additional amount of the liquid medium to form the liquid developer composition. Generally, the concentration of the toner particles in the hydrocarbon is from about 0.4 percent by weight to about 6 percent by weight and preferably from about 0.8 percent to about 2.0 percent by weight. Thereafter, a charge control agent is added to the dispersion formed to enable an electrophoretic liquid developer composition. The final developer generally comprises the liquid medium in an amount of from about 94 to about 99.6 percent by weight, preferably from about 97 to about 99.5 percent by weight, the composite toner particles (consisting of "core" colored copolymer and polymeric surfactant) in an amount of from about 0.4 to about 6 percent by weight, and preferably from about 0.8 to about 2.0 percent by weight, and the charge control agent in an amount of from about 0.01 to about 0.2 percent by weight, preferably from about 0.02 to about 0.2 percent by weight, although the amounts of each of these components can be outside of this range. Generally, the charge to mass ratio of the toner particles in the developer is from about 50 to about 150 microcoulombs per gram, and preferably from about 70 to about 130 microcoulombs per gram.

The liquid developers of this embodiment of the invention are useful in known imaging and printing process. These liquid developers may be employed in imaging methods wherein an electrostatic latent image is formed on an imaging member and developed with the developer composition illustrated herein. If desired, the developed image can be transferred from the imaging member to a suitable substrate such as paper, cloth, transparency material, or the like, and thereafter, if necessary, affixed to the substrate by any conventional means, such as heat, pressure, combinations thereof, or the like.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

1,5-Bis(p-Hydroxyphenylthio)Anthraquinone (I)

A mixture of 27.7 grams (0.1 mole) of 1,5-dichloroanthraquinone, 28.5 grams (0.22 mole) of p-hydroxythiophenol, 30 grams (0.22 mole) of potassium carbonate, and 200 milliliters of dimethyl formamide was heated with stirring at 145° C. for 4 hours. The mixture was then cooled to room temperature, and poured into 1.5 liters of water. Thereafter, the above product was isolated by filtration, washed with 500 milliliters of water, and air dried. The product was then recrystallized from acetic acid to yield 30 grams of 1,5-bis(p-hydroxyphenylthio)anthraquinone as a yellow powder, m.p. (melting point) 298° to 300° C.; ms 456 (M+); vis (DMF), $\lambda_{max}$ 450 nm (nanometers) ($\epsilon$ 6300); Analysis Calculated for $C_{26}H_{16}O_4S_2$: C, 68.4; H, 3.53; O, 14.02; S, 14.05. Found: C, 67.93; H, 3.60; O, 14.05; S, 14.26.

EXAMPLE II

1,5-Bis(p-Hydroxyphenylthio)-4,8-Bis(Phenylthio)Anthraquinone (III)

A mixture of 22 grams (0.2 mole) of benzenethiol, 25.6 grams (0.2 mole) of potassium carbonate in 100 milliliters of dimethyl formamide was heated with stirring to 120° C. for 2 hours. The cooled mixture was added to a cold mixture of 36.6 grams (0.1 mole) of 1,5-dichloro-4,8-dinitroanthraquinone in 150 milliliters of dimethyl formamide, and stirred for 3 hours at room temperature. After addition of 25.6 grams (0.2 mole) of p-hydroxybenzenethiol in 100 milliliters of dimethyl formamide, the mixture was stirred at 125° C. for 2 hours. The resulting reaction mixture was then cooled, and poured slowly into 2 liters of water. Subsequently, the above solid product III was filtered, washed once with water, acetic acid, methanol, respectively, and then dried in vacuo. The yield of this dye was 50 grams (75 percent), m.p. >340° C.; vis (DMF), $\lambda_{max}$ 540 nm ($\epsilon$ 12,000); Analysis Calculated for $C_{38}H_{24}O_4S_4$: C, 67.83; H, 3.59; O, 9.51; S, 19.06. Found: C, 67.51; H, 3.89; O, 9.35; S, 19.32.

EXAMPLE III

1,8-Bis[2-(p-Hydroxyphenyl)Ethylamino]Anthraquinone (IV)

A mixture of 27.7 grams (0.1 mole) of 1,8-dichloroanthraquinone, and 30 grams (0.22 mole) of p-(2-aminoethyl)phenol in 200 milliliters of o-dichlorobenzene was heated to 160° C. for 18 hours. The mixture was cooled to room temperature, and the product was collected by filtration. Thereafter, the aforementioned product was recrystallized from isopropanol to yield 29 grams (62 percent) of 1,8-bis[2-(p-hydroxyphenyl)ethylamino]anthraquinone as a red powder, m.p. 181° to 182° C.; vis (DMF), $\lambda_{max}$ 520 nm ($\epsilon$ 12,000); ms 478 (M+); Analysis Calculated for $C_{30}H_{26}N_2O_4$: C, 75.29; H, 5.48; N, 5.86; O. 13.38. Found: C, 74.94; H, 5.30; N, 5.63; O, 13.17.

EXAMPLE IV

1,4-Bis(p-Hydroxyphenylamino)Anthraquinone (VI)

A well-stirred mixture of 19.2 grams (0.08 mole) of quinizarine, 5.2 grams (0.02 mole) of leucoquinizarine, 30 grams (0.28 mole) of p-aminophenol, 1 gram of boric acid, and 150 milliliters of ethanol were heated under reflux for 72 hours. The resulting reaction mixture was then cooled to room temperature and filtered. Subsequently, the above product VI resulting was washed with ethanol and recrystallized from acetic acid. The yield of this blue dye was 30 grams (71 percent), m.p. 340° to 342° C.; ms 422 (M+); vis (DMF), $\lambda_{max}$ 639 nm ($\epsilon$ 15,000); Analysis Calculated for $C_{26}H_{18}N_2O_4$; C, 73.92; H, 4.29; N, 6.63; O, 15.15. Found: C, 73.50; H, 4.60; N, 6.45; O, 15.25.

EXAMPLE V

1,4-Bis[2-(p-Hydroxyphenyl)Ethylamino]Anthraquinone (VII)

A mixture of 21 grams (0.09 mole) of leucoquinizarine, 30 grams (0.22 mole) of p-(2-aminoethyl)phenol in 150 milliliters of pyridine was refluxed for 12 hours. The mixture was cooled to room temperature and poured into 2 liters of water. Thereafter, the product resulting was filtered, washed with water, and recrystallized from acetic acid to yield 26 grams, (60 percent) of 1,4-bis[2-(p-hydroxyphenyl)ethylamino] anthraquinone as a blue powder, m.p. 240° to 242° C.; vis(DMF), $\lambda_{max}$ 644 nm($\epsilon$ 16,600); 598 nm($\epsilon$ 14,100); ms 478 (M+); Analysis Calculated for $C_{30}H_{26}N_2O_4$: C, 75.29; H, 5.48; N, 5.86; O, 13.38. Found: C, 75.46; H, 5.32; N, 5.69; O, 13.26.

EXAMPLE VI

Yellow Polycarbonate (X)

A mixture of 32.2 grams (0.15 mole) of 2,2-bis(p-hydroxyphenyl)propane and 4.8 grams (0.0105 mole) of 1,5-bis(p-hydroxyphenylthio)anthraquinone was dissolved in 400 milliliters of methylene chloride in the presence of 38 milliliters of pyridine. The resulting solution was cooled in an ice bath to 5°-10° C. Thereafter, there were added 41 grams (0.177 mole) of diethyleneglycol bischloroformate at a rate sufficient to maintain the reaction temperature at from 10°-15° C. The addition was carried out over a period of 30 minutes. Subsequently, the mixture was stirred at room temperature for 2 hours, and then 600 milliliters of methylene chloride was added thereto. The resulting solution was washed twice with water, and once with brine. After drying over anhydrous magnesium sulfate, the solution was concentrated to 250 milliliters and added dropwise to 5 liters of hexane with vigorous agitation. The precipitated polycarbonate product was filtered, washed with hexane and dried in vacuo. The yield of polycarbonate X(x=0.065, y=0.935) was 99%; $T_g$, 56° C. IR (neat) $cm^{-1}$ 2980(w), 1775(s), 1515(m), 1270(s), 1220(s), 1090(m), 1020(m).

EXAMPLE VII

Red Polyester (XI)

A solution of 11.4 grams (0.05 mole) of 2,2-bis(p-hydroxyphenyl)propane, 1.05 grams (0.0025 mole) of 1,5-bis(p-hydroxyphenylthio)-4,8-bisphenylthioanthraquinone, and 9.4 grams of pyridine in 125 milliliters of methylene chloride was cooled with an ice bath to 15° C. A solution of 8.87 grams (0.0525 mole) of glutaryl chloride in 10 milliliters of methylene chloride was added dropwise over a period of 20 minutes. Subsequently, the reaction mixture was stirred at room temperature for another 5 hours before being diluted with 100 milliliters of methylene chloride. The resulting solution was washed twice with water and once with brine. After drying over anhydrous magnesium sulfate, the solution was concentrated to 75 milliliters, and added dropwise to 2 liters of stirring methanol. The precipitate was isolated by filtration, and washed with methanol. There resulted the red polyester XI(x=0.048, y=0.952) in an 85% yield; $T_g$, 78° C. IR (neat) $cm^{-1}$: 2980(w), 1760(s), 1515(m), 1270(s), 1220(s), 1090(m), 1020(m).

EXAMPLE VIII

Blue Polyester (XIV)

A blue polyester resin represented by structure XIV with x=0.048 and y=0.952 was synthesized in accordance with the procedure of Example VII with the exception that 0.0025 mole of 1,4-bis(p-hydroxyphenylamino)anthraquinone was used as the functionalized dye. The yield of polyester XIV was 95%; $T_g$, 80° C. IR (neat) $cm^{-1}$ 2980(w), 1760(s), 1515(m), 1270(s), 1220(s), 1090(m), 1020(m).

EXAMPLE IX

Green Polycarbonate (XV)

A green polycarbonate resin represented by structure XV with x=0.046, y=0.926 and z=0.028 was synthesized in accordance with the procedure of Example VI with the exception that 0.0075 mole of 1,4-bis(p-hydroxyphenylamino)anthraquinone and 0.0045 mole of 1,5-bis(p-hydroxyphenylthio)anthraquinone were used in place of 0.0105 mole of 1,5-bis(p-hydroxyphenylthio)anthraquinone. The yield of green polycarbonate XV was 95%; $T_g$, 66° C. IR (neat) $cm^{-1}$ 2980(w), 1775(s), 1515(m), 1270(s), 1220(s), 1090(m), 1020(m).

EXAMPLE X

Red Polycarbonate (XIII)

A red polycarbonate resin represented by structure XIII with x=0.091 and y=0.909 was prepared in accordance with the procedure of Example VI except that 0.015 mole of 1,5-bis(p-hydroxyphenylthio)-4,8-bis(-phenylthio)anthraquinone was used in place of 1,5-bis(p-hydroxyphenylthio)anthraquinone. The yield of polycarbonate XIII was 91%; $T_g$, 63° C. IR (neat) $cm^{-1}$, 2980(w), 1775(s), 1515(m), 1270(s), 1220(s), 1090(m), 1020(m).

EXAMPLE XI

Blue Polycarbonate (XVII)

A blue polycarbonate resin represented by structure XVII with x=0.091 and y=0.909 was synthesized in accordance with the procedure of Example VI using 0.015 mole of 1,4-bis[2-(p-hydroxyphenyl)ethylamino]anthraquinone instead of 1,5-bis(p-hydroxyphenylthio)anthraquinone. The yield of polycarbonate XVII was 91%; Tg, 67° C. IR (neat) $cm^{-1}$, 2980(w), 1775(s), 1515(m), 1270(s), 1220(s), 1090(m), 1020(m).

EXAMPLE XII

Red Polycarbonate (XII)

A red polycarbonate resin represented by structure XII with x=0.091 and y=0.909 was synthesized in accordance with the procedure of Example XI using 1,8-bis[2-(p-hydroxyphenyl)ethylamino]anthraquinone. IR (neat) $cm^{-1}$, 2980(w), 1775(s), 1515(m), 1270(s), 1220(s), 1090(m), 1020(m).

EXAMPLE XIII

Red Polyester (XVI)

A red polyester of structure XVI with x=0.048 and y=0.952 was synthesized in accordance with the procedure of Example VIII using 1,4-bis(p-hydroxyphenylthio)anthraquinone and adipoyl chloride instead of 1,4-bis(p-hydroxyphenylamino)anthraquinone and glutaryl chloride. The yield of polyester XVI was 93%; $T_g$, 74° C. IR (neat) $cm^{-1}$, 2980(w), 1760(s), 1515(m), 1270(s), 1220(s), 1090(m), 1020(m).

EXAMPLE XIV

Red Polyesters (XVIII)

A series of red polyesters with a 7 mole percent loading of the red chromophore as represented by structure XVIII [B+M=0.07, and A+N=0.93] were synthesized in accordance with the procedure of Example VII using a mixture of 2 acyl chlorides, namely, glutaryl chloride and sebacoyl chloride instead of just glutaryl chloride. The dependence of Tg of the resultant polyester on the proportions of the two acyl chlorides used [i.e. (A+B) and (M+N)] is depicted in FIG. 1. It is evident from the Figure that colored polyesters XVIII of desirable Tg for fusing purposes can be synthesized. These polyesters displayed infrared spectral properties as follows (neat): 2980(w), 1760(s), 1515(m), 1270(s), 1220(s), 1090(m), 1020(m) $cm^{-1}$.

EXAMPLE XV

Yellow Polyester (XX)

A mixture of 0.020 mole of 1,5-bis(p-hydroxyphenylthio)anthraquinone obtained from Example I and 0.04 mole of sodium hydroxide was dissolved in 150 milliliters of water. To this mixture was added 1.5 gram of the dispersing agent sodium lauryl sulfate in 30 milliliters of water, and the resulting solution was mechanically stirred vigorously at room temperature. A solution of 0.022 mole of sebacoyl chloride in 80 milliliters of methylene chloride was then added, and the reaction mixture was stirred for 30 minutes before pouring into 3 liters of water. The solid polymer product was filtered, washed repeatedly with water to remove sodium chloride and the dispersing agent, and dried in vacuo. The yield of yellow polyester XX was 81 percent, $M_n$ (number average molecular weight) 4,700 (relative to polystyrene standards); IR (neat), 1760(s) $cm^{-1}$.

EXAMPLE XVI

Red Polycarbonate (XXII)

To a solution of 0.063 mole of 1,8-bis[2-(p-hydroxyphenyl)-ethylamino]anthraquinone obtained from Example III, and 35 milliliters of triethylamine in 300 milliliters of methylene chloride at 5° to 10° C. was added a solution of 0.065 mole of diethyleneglycol bischloroformate in 15 milliliters of methylene chloride. The addition was accomplished at a rate that the temperature of the reaction mixture remained below 15° C. The addition was completed in approximately 15 minutes. Subsequently, the mixture resulting was stirred at room temperature for 1.5 hours. Thereafter, the reaction mixture was washed several times with water and dried over anhydrous magnesium sulfate. The above product polymer XXII was precipitated from the solution by pouring the latter into hexane with vigorous stirring. After filtration by suction, the solid product XXII was washed with hexane and dried in vacuo. The yield was 87 percent, $M_n$, 12,400; IR(neat), 1775(s) $cm^{-1}$.

EXAMPLE XVII

Red Polyester (XXIII)

A red polyester represented by formula XXIII was synthesized in accordance with the procedure of Example XVI with the exception of 0.063 mole of 1,5-bis(p-hydroxyphenylthio)-4,8-bis(phenylthio)-anthraquinone and 0.065 mole of adipolyl chloride were employed, respectively, in place of 1,5-bis[p-hydroxyphenylthio)anthraquinone and sebacoyl chloride. The yield of polyester XXIII was 76 percent; $M_n$, 7,150; IR (neat) 1760(s) $cm^{-1}$.

EXAMPLE XVIII

Blue Polycarbonate (XXV)

A blue polycarbonate represented by formula XXV was synthesized in accordance with the procedure of Example XV with the exception that 0.060 mole of 1,4-bis[2-(p-hydroxyphenyl)ethylamino]-anthraquinone and 0.063 mole of triethyleneglycol bischloroformate were selected, respectively, in place of 1,5-bis(p-hydroxyphenylthio)anthraquinone and sebacoyl chloride. The yield of blue polycarbonate XV was 87 percent; $M_n$, 7,300; IR(neat), 1775(s) $cm^{-1}$.

EXAMPLE XIX

Blue Polyester (XXIV)

A blue polyester represented by formula XXIV was prepared in accordance with the procedure of Example XVI with the exceptions that 0.060 mole of 1,4-bis(p-hydroxyphenylamino)anthraquinone was employed in place of 1,5-bis(p-hydroxyphenylthio)anthraquinone, and reaction completion was in 3 hours. The yield of blue polyester XXIV was 79 percent; $M_n$, 10,700; IR(neat), 1760(s)$cm^{-1}$.

EXAMPLE XX

Yellow Polycarbonate (XXI)

A yellow polycarbonate represented by formula XXI was synthesized by repeating the procedure of Example XVI using 1,5-bis(p-hydroxyphenylthio)anthraquinone and triethyleneglycol bischloro-formate instead of 1,8-bis[2-(p-hydroxyphenyl)ethylamino] anthraquinone and diethyleneglycol bischloroformate, respectively. The yield of yellow polycarbonate XXI was 72 percent; $M_n$, 11,900; IR (neat), 1775(s) $cm^{-1}$.

EXAMPLE XXI

Red Liquid Developer

To a Union Process attritor was added 70.0 grams of a high purity isoparaffinic hydrocarbon (Isopar® G, obtained from Exxon Corporation). To the hydrocarbon liquid was added 5.0 grams of a chlorinated polyolefin (CP-343-1, obtained from Eastman Kodak Company), and the chlorinated polyolefin was dissolved in the hydrocarbon by heating at 80° C. with constant stirring for 30 minutes. The temperature of the attritor was subsequently reduced to about 50° C., and a solution of 2.0 grams of red polycarbonate XIII (prepared as described in Example X) in 20.0 grams of methylene chloride was added very slowly with vigorous stirring, resulting in the formation of red colloidal particles in the hydrocarbon medium. After the addition of red polycarbonate XIII, stirring was continued for another 15 minutes at 50° C., and subsequently stirring was continued at 80° C. for 60 minutes to evaporate off methylene chloride. The resulting colloidal suspension of colored particles was allowed to cool to room temperature, after which basic barium petronate (obtained from Witco Chemical Corporation, Organic Division) was added to the suspension as a charge control agent in an amount of 20 milligrams of basic barium petronate per gram of solid content in the suspension, resulting in the colored particles becoming negatively charged. The red liquid developer thus formed was incorporated into a Savin® 780 copier having a selenium photoreceptor and employing liquid development processes. Latent images were formed on the photoreceptor by charging the photoreceptor and then exposing the photoreceptor to a light image, resulting in images with a contrast potential of from about 800 to about 1,000 volts (wherein contrast potential refers to the difference in voltage between image areas and background areas on the photoreceptor). The latent images were developed with the liquid developer, transferred to Xerox® 4024 paper, and fused with radiant energy, resulting in high quality red images.

EXAMPLE XXII

Blue Liquid Developer

To 70.0 grams of a high purity isoparaffinic hydrocarbon (Isopar ® G, obtained from Exxon Corporation) in a beaker was added 5.0 grams of a chlorinated polyolefin (CP-343-1, obtained from Eastman Kodak Company), and the chlorinated polyolifin was dissolved in the hydrocarbon by heating at 80° C. with constant stirring for 30 minutes. The resulting solution was then cooled to 50° C. and was then stirred with a Brinkmann homogenizer. A solution of 2.5 grams of blue polyester XIV (prepared as described in Example VIII) in 15 grams of methylene chloride was then added slowly to the solution with the homogenizer operating at 6,000 rps (revolutions per second) over a period of 30 minutes. The resulting colloidal suspension of blue particles was then evaporated under reduced pressure to remove the methylene chloride, followed by addition of lecithin (obtained from Fisher Scientific Company) as a charge control agent in an amount of 20 milligrams of lecithin per gram of solid content in the suspension, resulting in the blue particles becoming negatively charged. The blue liquid developer thus formed was incorporated into a Savin ® 780 copier having a selenium photoreceptor and employing liquid development processes. Latent images were formed on the photoreceptor by charging the photoreceptor and then exposing the photoreceptor to a light image, resulting in images with a contrast potential of from about 800 to about 1,000 volts (wherein contrast potential refers to the difference in voltage between image areas and background areas on the photoreceptor). The latent images were developed with the liquid developer, transferred to Xerox ® 4024 paper, and fused with radiant energy, resulting in high quality blue images.

EXAMPLE XXIII

Green Liquid Developer

To 70.0 grams of a high purity isoparaffinic hydrocarbon (Isopar ® G, obtained from Exxon Corporation) in a beaker was added 5.0 grams of a chlorinated polyolefin (CP-343-1, obtained from Eastman Kodak Company), and the chlorinated polyolefin was dissolved in the hydrocarbon by heating at 80° C. with constant stirring for 30 minutes. The resulting solution was then cooled to 50° C. and was then sonicated with an Ultrasonic Inc. sonicator Model W375 while a solution of 2.0 grams of green polycarbonate XV (prepared as described in Example IX) in 15 grams of methylene chloride was added slowly over a period of 20 minutes. The resulting colloidal suspension of green particles was then evaporated under reduced pressure to remove the methylene chloride, followed by addition of lecithin as a charge control agent in an amount of 20 milligrams of lecithin (obtained from Fisher Scientific Company) per gram of solid content in the suspension, resulting in the green particles becoming negatively charged. The green liquid developer thus formed was incorporated into a Savin ® 780 copier having a selenium photoreceptor and employing liquid development processes. Latent images were formed on the photoreceptor by charging the photoreceptor and then exposing the photoreceptor to a light image, resulting in images with a contrast potential of from about 800 to about 1,000 volts (wherein contrast potential refers to the difference in voltage between image areas and background areas on the photoreceptor). The latent images were developed with the liquid developer, transferred to Xerox ® 4024 paper, and fused with radiant energy, resulting in high quality green images.

EXAMPLE XXIV

Yellow Liquid Developer

To 70.0 grams of a high purity isoparaffinic hydrocarbon (Isopar ® G, obtained from Exxon Corporation) in a beaker was added 5.0 grams of a chlorinated polyolefin (CP-343-1, obtained from Eastman Kodak Company), and the chlorinated polyolefin was dissolved in the hydrocarbon by heating at 80° C. with constant stirring for 30 minutes. The resulting solution was then cooled to 50° C. and was then stirred with a Brinkmann homogenzier. A solution of 1.5 grams of yellow polycarbonate XXI (prepared as described in Example XX) in 15 grams of methylene chloride was then added slowly to the solution with the homogenizer operating at 6,000 rps (revolutions per second) over a period of 30 minutes. The resulting colloidal suspension of yellow particles was then evaporated under reduced pressure to remove the methylene chloride, followed by addition of lecithin (obtained from Fisher Scientific Company) as a charge control agent in an amount of 20 milligrams of lecithin per gram of solid content in the suspension, resulting in the yellow particles becoming negatively charged. The brilliant yellow liquid developer thus formed was incorporated into a Savin ® 780 copier having a selenium photoreceptor and employing liquid development processes. Latent images were formed on the photoreceptor by charging the photoreceptor and then exposing the photoreceptor to a light image, resulting in images with a contrast potential of from about 800 to about 1,000 volts (wherein contrast potential refers to the difference in voltage between image areas and background areas on the photoreceptor). The latent images were developed with the liquid developer, transferred to Xerox ® 4024 paper, and fused with radiant energy, resulting in high quality yellow images.

EXAMPLE XXV

Red Liquid Developer

To 70.0 grams of a high purity isoparaffinic hydrocarbon (Isopar ® G, obtained from Exxon Corporation) in a beaker was added 5.0 grams of a chlorinated polyolefin (CP-343-1, obtained from Eastman Kodak Company), and the chlorinated polyolefin was dissolved in the hydrocarbon by heating at 80° C. with constant stirring for 30 minutes. The resulting solution was then cooled to 50° C. and was then sonicated with an Ultrasonic Inc. sonicator Model W375 while a solution of 1.0 gram of red polyester XXIII (prepared as described in Example XVII) in 15 grams of methylene chloride was added slowly over a period of 20 minutes. The resulting colloidal suspension of red particles was then evaporated under reduced pressure to remove the methylene chloride, followed by addition of lecithin (obtained from Fisher Scientific Company) as a charge control agent in an amount of 20 milligrams of lecithin per gram of solid content in the suspension, resulting in the red particles becoming negatively charged. The red liquid developer thus formed was incorporated into a Savin ® 780 copier having a selenium photoreceptor and employing liquid development processes. Latent images were formed on the photoreceptor by charging the photoreceptor and then exposing the photoreceptor to a light image, resulting in images with a contrast potential of from about 800 to about 1,000 volts (wherein contrast potential refers to the difference in voltage between image areas and background areas on the photoreceptor). The latent images were developed with the liquid developer, transferred to Xerox® 4024 paper, and fused with radiant energy, resulting in high quality red images.

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer comprising a hydrocarbon liquid medium, a charge control agent, a polymeric surfactant, and a colored core polymer comprising a polymeric backbone having a color chromophore covalently bound thereto, wherein the colored polymer is of the formula:

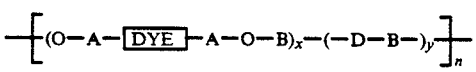

wherein A is selected from the group consisting of alkylene and arylene, B is selected from the group consisting of

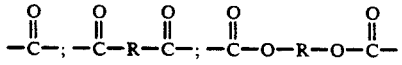

wherein R is selected from the group consisting of alkylene groups, arylene groups, and polyether groups, D is selected from the group consisting of dioxyalkane and dioxyarene, x is a fraction number of from about 0.01 to 1.0, and y is a fraction number of from 0 to about 0.99, with x+y being equal to 1, and n representing the number of the monomer units.

2. A liquid developer according to claim 1 wherein the colored polymer is present in an amount of from about 0.1 to about 30 percent by weight.

3. A liquid developer according to claim 1 wherein the polymeric surfactant is present in an amount of from about 0.4 to about 10 percent by weight.

4. A liquid developer according to claim 1 wherein the polymeric surfactant is selected from the group consisting of polyolefins and halogenated polyolefins.

5. A liquid developer according to claim 1 wherein the polymeric surfactant is a chlorinated polypropylene.

6. A liquid developer according to claim 1 wherein the polymeric surfactant is selected from the group consisting of polyhexadecenes and polyoctadecenes.

7. A liquid developer according to claim 1 wherein the liquid medium is an aliphatic hydrocarbon.

8. A liquid developer according to claim 1 wherein the charge control agent is selected from the group consisting of lithium salts of heptanoic acid, cadmium salts of heptanoic acid, calcium salts of heptanoic acid, manganese salts of heptanoic acid, magnesium salts of heptanoic acid, zinc salts of heptanoic acid, barium salts of 2-ethyl hexanoic acid, aluminum salts of 2-ethyl hexanoic acid, cobalt salts of 2-ethyl hexanoic acid, mangenese salts of 2-ethyl hexanoic acid, zinc salts of 2-ethyl hexanoic acid, cerium salts of 2-ethyl hexanoic acid, zirconium salts of 2-ethyl hexanoic acid, barium salts of stearic acid, aluminum salts of stearic acid, zinc salts of stearic acid, copper salts of stearic acid, lead salts of stearic acid, iron salts of stearic acid, calcium salts of naphthenic acid, copper salts of naphthenic acid, manganese salts of naphthenic acid, nickel salts of naphthenic acid, zinc salts of naphthenic acid, iron salts of naphthenic acid, ammonium lauryl sulfate, sodium dihexyl sulfosuccinate, sodium dioctyl sulfosuccinate, aluminum diisopropyl salicylate, aluminum dresinate, aluminum salts of 3,5 di-t-butyl gamma resorcylic acid, lecithin, polyisobutylene succinimide, basic barium petronate, and mixtures thereof.

9. A liquid developer according to claim 1 wherein the dye is selected from the group consisting of

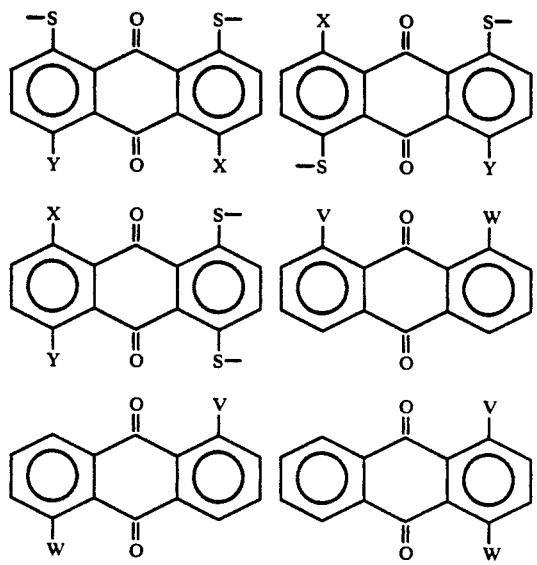

wherein X and Y are independently selected from the group consisting of $SC_6H_5$, $SCH_3$, $SC_2H_5$, and H; V and W are independently selected from the group consisting of $NH(CH_2)_n$—, $NHC_6H_4$—, $NH(CH_2)_nC_6H_4$—, and $NHC_6H_4(CH_2)_n$—; and n is a number of from zero to about 20.

10. A liquid developer according to claim 1 wherein the alkylene group contains from about 1 to about 20 carbon atoms.

11. A liquid developer according to claim 1 wherein the B segment is —$CO_2CH_2CH_2OCO$—.

12. A liquid developer according to claim 1 wherein the B segment is —$CO_2(CH_2CH_2O)_2CO$—.

13. A liquid developer according to claim 1 wherein the B segment is —$CO_2(CH_2CH_2O)_3CO$—.

14. A liquid developer according to claim 1 wherein the B segment is —$CO_2(CH_2)_3CO$—.

15. A liquid developer according to claim 1 wherein the B segment is —$CO_2(CH_2)_4CO$—.

16. A liquid developer according to claim 1 wherein the B segment is —$CO_2(CH_2)_8CO$—.

17. A liquid developer according to claim 1 wherein the B segment is —$CO_2CH_2OCO$—.

18. A liquid developer according to claim 1 wherein the B segment is dioxymethylene.

19. A liquid developer according to claim 1 wherein the B segment is dioxybenzene.

20. A liquid developer according to claim 1 wherein the arylene group is selected from the group consisting of ortho-phenylene, meta-phenylene, para-phenylene, benzophenylene, and tolylene.

21. A liquid developer according to claim 1 wherein n is from about 2 to about 200.

22. A liquid developer according to claim 1 wherein the colored polymer is of the formula wherein y=0.

23. A liquid developer according to claim 1 wherein v=0 and n is from about 2 to about 100.

24. An imaging process which comprises forming an electrostatic latent image on an imaging member and developing the image with a liquid developer according to claim 1.

25. An imaging process according to claim 24 wherein the colored polymer is of the formula wherein y=0.

* * * * *